US008550062B2

(12) United States Patent
Maeda

(10) Patent No.: US 8,550,062 B2
(45) Date of Patent: Oct. 8, 2013

(54) TOY GUN

(75) Inventor: Tetsuo Maeda, Tokyo (JP)

(73) Assignee: Maruzen Company Limited, Tokyo (JP)

( * ) Notice: Subject to any disclaimer, the term of this patent is extended or adjusted under 35 U.S.C. 154(b) by 0 days.

(21) Appl. No.: 13/358,664

(22) Filed: Jan. 26, 2012

(65) Prior Publication Data

US 2013/0192578 A1 Aug. 1, 2013

(51) Int. Cl.
*F41B 11/00* (2013.01)

(52) U.S. Cl.
USPC ..... 124/74; 124/56

(58) Field of Classification Search
USPC ..... 124/56, 74
See application file for complete search history.

(56) References Cited

U.S. PATENT DOCUMENTS

| | | | | |
|---|---|---|---|---|
| 3,999,534 | A * | 12/1976 | Chapin et al. | 124/74 |
| 6,029,645 | A * | 2/2000 | Wonisch et al. | 124/74 |
| 6,494,194 | B2 * | 12/2002 | Shipachev et al. | 124/73 |
| 7,290,539 | B2 * | 11/2007 | Maeda et al. | 124/74 |
| 7,757,682 | B2 * | 7/2010 | Kaminker et al. | 124/74 |
| 2006/0260596 | A1 * | 11/2006 | Maeda et al. | 124/74 |
| 2007/0181116 | A1 * | 8/2007 | Wei | 124/74 |
| 2008/0141991 | A1 * | 6/2008 | Liu | 124/56 |

FOREIGN PATENT DOCUMENTS

DE 195 42 326 A1 5/1997

OTHER PUBLICATIONS

Extended European Search Report in EP application No. 12000324.9, dated Jun. 29, 2012.

* cited by examiner

*Primary Examiner* — Samir Abdosh
*Assistant Examiner* — Derrick Morgan
(74) *Attorney, Agent, or Firm* — Rader, Fishman & Grauer PLLC

(57) ABSTRACT

A gas cartridge is firmly attached to a toy gun and the gas cartridge is replaced through simple operation. The gas cartridge is filled therein with compressed gas for firing a bullet. A cartridge housing portion slidably holds the circumferential surface of the gas cartridge. The lid portion of the gas cartridge housed in the cartridge housing portion is coupled to a cartridge attachment portion. A clamp arm has a roller and an extended portion and can be freely rotated around a rotation shaft. When the clamp arm is rotated, the roller presses the bottom portion of the gas cartridge in the cartridge housing portion. A raising lever has an abutment portion and is coupled to the extended portion so that the raising lever can be rotated around an installation shaft. When the raising lever is moved, the abutment portion slides on the sliding surface and rotates the clamp arm.

3 Claims, 14 Drawing Sheets

TOY GUN

BACKGROUND OF THE INVENTION

1. Field of the Invention

The present invention relates to a toy gun to which a gas cartridge filled with compressed gas can be attached and which fires a bullet utilizing the injection pressure of the compressed gas.

2. Description of Related Art

Toy guns to which a gas cartridge filled with compressed gas of carbon dioxide or the like can be attached and which fire a bullet utilizing the injection pressure of the compressed gas conventionally exist. The compressed gas is discharged according to operation with the trigger provided in the toy gun and hits a bullet loaded in the toy gun to fire the bullet. In such a toy gun, the following are both important: that a gas cartridge is reliably attached and does not come off and that a gas cartridge can be easily replaced.

FIG. 4, FIG. 6, FIG. 8, and FIG. 10 in the specification of U.S. Pat. No. 7,290,539 will be referred to. A cartridge housing portion 2 for housing a high-pressure gas cartridge A is formed in the grip portion 1 of the air gun G described in the specification of U.S. Pat. No. 7,290,539. The cartridge housing portion 2 is open in a side surface of the grip portion 1.

A clamp lever portion 30 is attached to the area extended from the rear part to the lower part of the grip portion 1. The clamp lever portion 30 can be rotated around a lever rotation shaft 5 provided on the bottom surface 4 of the grip portion 1. For this reason, a user of the air gun G can pull down the clamp lever portion 30 to the rear side of the air gun G. A roller portion 6 is provided above the lever rotation shaft 5 in the clamp lever portion 30. The roller portion 6 has a rotating shaft in the center thereof and can be freely rotated around the rotating shaft. The roller portion 6 forms a pressing portion that presses the bottom portion A1 of the high-pressure gas cartridge A. Patent Document 1 describes that the pressing portion may be comprised of a columnar member that does not rotate.

When a back grip panel 3 is pulled down backward, the roller portion 6 retreats and a high-pressure gas cartridge A can be attached to or detached from the cartridge housing portion 2 from the lateral side of the grip portion 1. (Refer to FIG. 6 in the specification of U.S. Pat. No. 7,290,539.) When the back grip panel 3 is pushed back forward with the high-pressure gas cartridge A attached to the cartridge housing portion 2, the roller portion 6 presses the bottom portion A1 of the high-pressure gas cartridge A to push the high-pressure gas cartridge A upward. (Refer to FIG. 8 and FIG. 10 in the specification of U.S. Pat. No. 7,290,539.)

In the air gun G described in the specification of U.S. Pat. No. 7,290,539, the following procedure must be taken to reliably house the high-pressure gas cartridge A in the cartridge housing portion 2: with the roller portion 6 pushing the high-pressure gas cartridge A upward, the clamp lever portion 30 must be firmly fixed to prevent the displacement thereof. In this case, a user is required to move the clamp lever portion 30 with very strong force to attach or detach the high-pressure gas cartridge A. For this reason, the clamp lever portion 30 provided in the air gun G is hard for a user to handle.

To enhance the handiness of the clamp lever portion 30, a tab portion to be pinched by a user could be provided in the clamp lever portion 30. However, if the tab portion is provided, the design of the clamp lever portion 30 will be impaired.

SUMMARY OF THE INVENTION

It is an object of the invention to make it possible to firmly attach a gas cartridge to a toy gun through simple operation to facilitate the replacement of the gas cartridge.

A toy gun of the invention includes: an air chamber body that forms an air chamber for storing compressed gas; a discharge mechanism for discharging compressed gas in the air chamber; a cartridge housing portion that houses a cylindrical gas cartridge filled with compressed gas and slidably holds the circumferential surface of the gas cartridge; the cartridge attachment portion to which the first end portion of a gas cartridge housed in the cartridge housing portion is coupled and which guides compressed gas in the gas cartridge to the air chamber; a pressing portion that presses the second end portion of the gas cartridge housed in the cartridge housing portion; and an extended portion extended to a position opposed to the circumferential surface of a gas cartridge housed in the cartridge housing portion. The toy gun is provided with: a first arm element freely rotatable around a rotation shaft; and a second arm element including an abutment portion that slides on a sliding surface, a fulcrum portion rotatably coupled to the extended portion, and an operation portion positioned on the fulcrum portion on the opposite side to the abutment portion.

According to the invention, the following takes place when a user of the toy gun moves the operation portion to slide the abutment portion along the sliding surface: the fulcrum portion is broken away from the cartridge housing portion and the first arm element rotates. The distance between the abutment portion and the operation portion is longer than the distance between the abutment portion and the fulcrum portion; therefore, the user only has to apply small force. Since the operation portion is brought far away from the cartridge housing portion, a user can easily pinch the operation portion. Therefore, it is possible to firmly attach a gas cartridge to the toy gun through simple operation and the gas cartridge can be easily replaced. It is unnecessary to provide the first arm element with a part to be pinched by a user. For this reason, the design of the toy gun is not impaired.

DETAILED DESCRIPTION OF THE PREFERRED EMBODIMENTS

Figure 1:
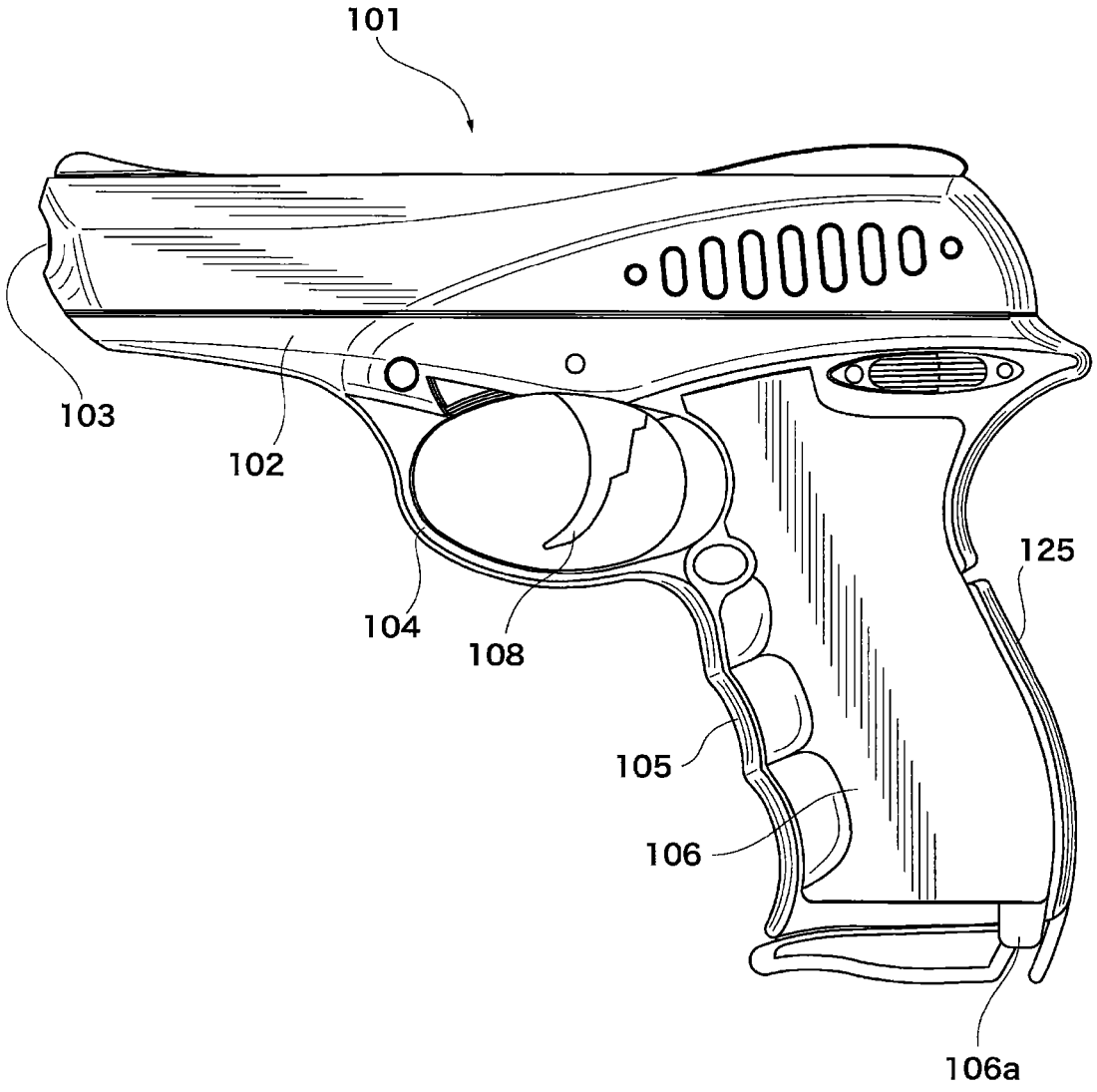
FIG. 1 is a side view of a toy gun.
Figure 2:
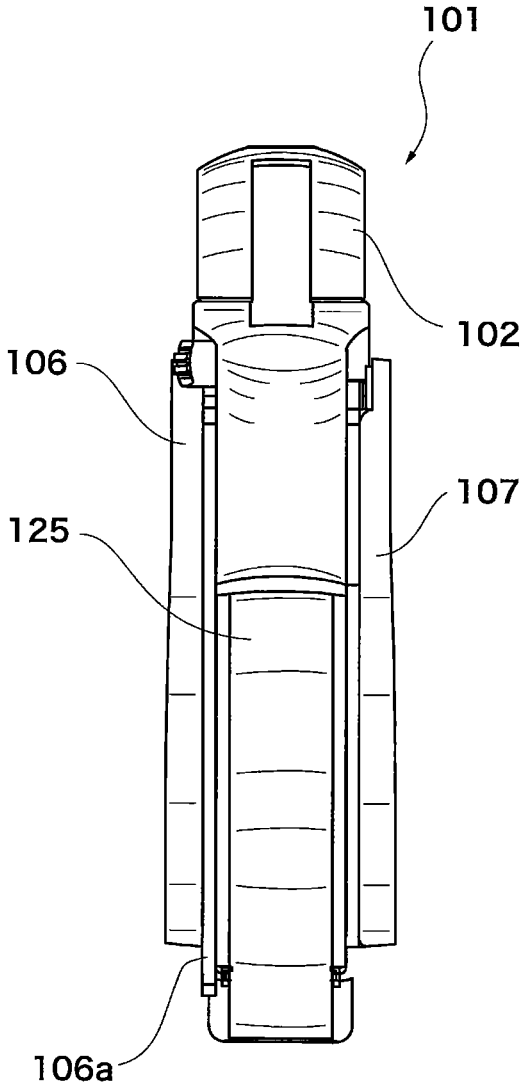
FIG. 2 is a side view of the rear side of a toy gun.

A description will be given to an embodiment with reference to FIG. 1 to FIG. 14. FIG. 1 is a side view of a toy gun 101. FIG. 2 is a side view of the rear side of the toy gun 101. In the following description, the side surface of the rear side of the toy gun 101 will be taken as a front face and the side of the toy gun 101 shown in FIG. 1 may be designated as left side.

The primary shape of the toy gun 101 is formed of a main frame 102. The main frame 102 forms each part, such as a muzzle 103, a trigger guard 104, and a grip 105. A left grip panel 106 is installed on the left side surface of the grip 105. A right grip panel 107 is installed on the right side surface of the grip 105.

The left grip panel 106 can be freely attached to and detached from the grip 105. A tab portion 106*a* is provided at the lower part of the left grip panel 106. The tab portion 106*a* is protruded downward from the lower side of the left grip panel 106. A user of the toy gun 101 can pinch the tab portion 106*a* to remove the left grip panel 106 from the grip 105.

The right grip panel 107 may be detachable from the grip 105 or may be fixed on the grip 105.

The toy gun 101 includes a trigger 108. The trigger 108 is positioned in a circular space formed by the trigger guard 104. The trigger 108 is moved in the front-rear direction of the toy gun 101.

Figure 3:
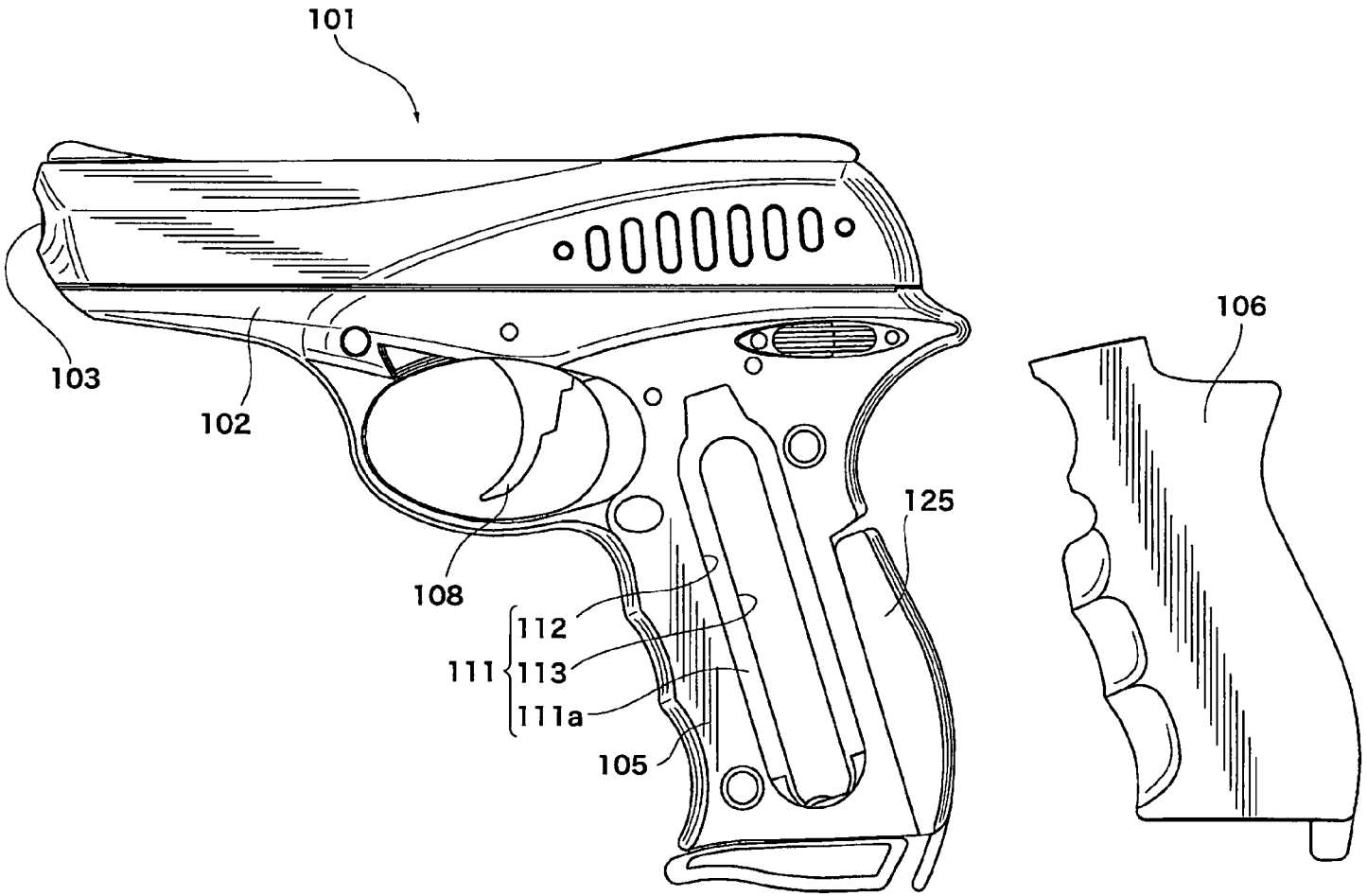
FIG. 3 is a left side view of a toy gun with the left grip panel thereof removed.

FIG. 3 is a left side view of the toy gun 101 with the left grip panel 106 removed. The grip 105 is provided with a cartridge housing portion 111. The cartridge housing portion 111 forms a cylindrical housing space 111*a* for housing a cylindrical gas cartridge B. (Refer to FIG. 11.) The cartridge housing portion 111 forms an introduction port 112 for introducing a gas cartridge B. The introduction port 112 is open in the left side surface of the grip 105 and makes communication between the housing space 111*a* and the external space. The cartridge housing portion 111 also forms a holding hole 113. The holding hole 113 is open in the right side surface of the grip 105 and makes communication between the housing space 111*a* and the external space. The holding hole 113 is smaller than the gas cartridge B. The gas cartridge B introduced from the introduction port 112 is slidably held in the introduction port 112 by the following with apart thereof protruded from the holding hole 113: the inner wall surface of the housing space 111*a* including the surrounding curved surface forming the holding hole 113.

Figure 4:
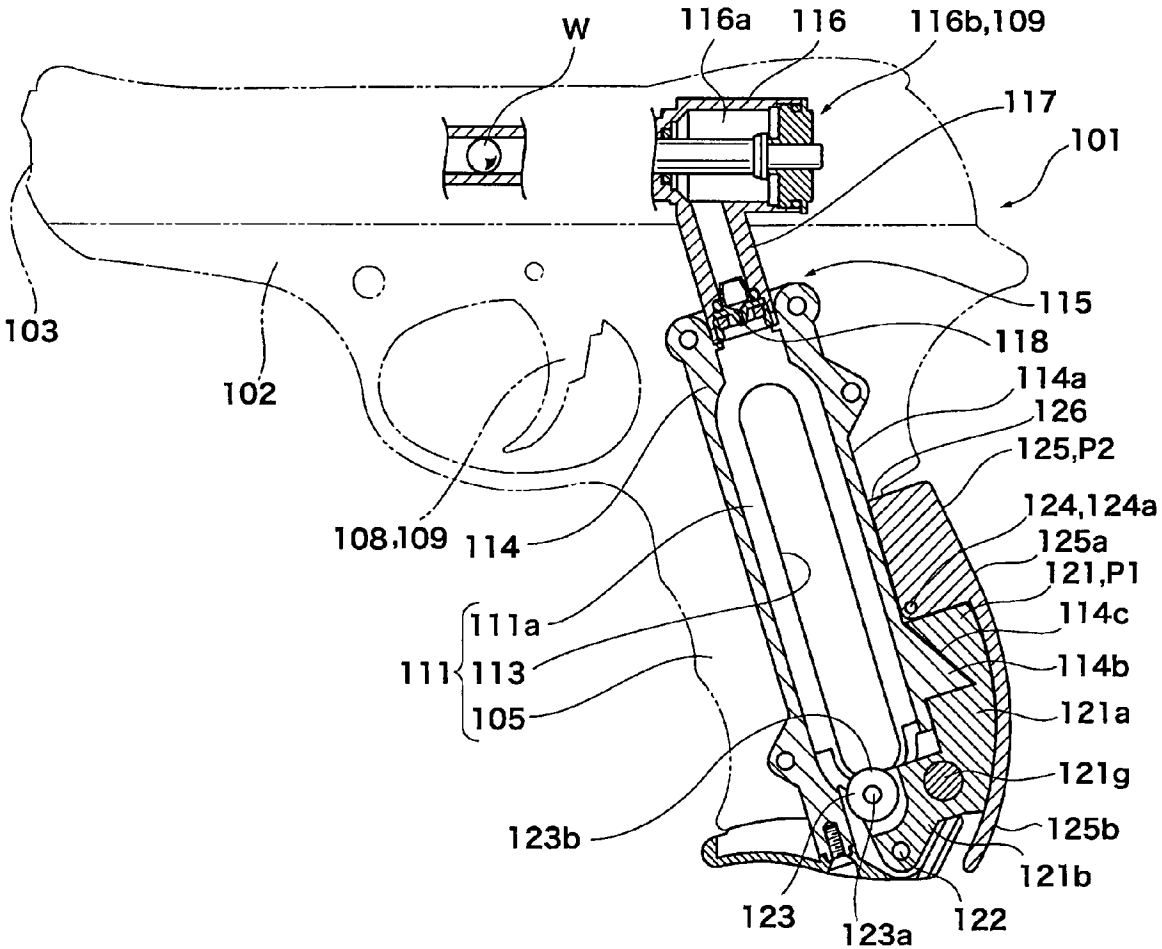
FIG. 4 is a sectional view of a toy gun.

FIG. 4 is a sectional view of the toy gun 101. The toy gun 101 includes an air chamber body 116. The air chamber body 116 forms an air chamber 116*a*. The air chamber 116*a* is hermetically closed. In the air chamber 116*a*, compressed gas PA is stored. (Refer to FIG. 13 and the like.) A cylindrical portion 117 is protruded from the air chamber body 116. The air chamber body 116 is provided with a gas spout mechanism 116*b*. The gas spout mechanism 116*b* discharges compressed gas PA in the air chamber 116*a* toward the muzzle 103 according to the movement of the trigger 108. The discharged compressed gas PA pushes a bullet W loaded in the toy gun 101 and shoots the bullet W out of the muzzle 103. Thus the trigger 108 and the gas spout mechanism 116*b* comprise a discharge mechanism 109.

The cylindrical portion 117 is provided therein with a cartridge attachment portion 118. The cartridge attachment portion 118 is in the shape of a hollow needle. The lid portion B1 (Refer to FIG. 11) of the gas cartridge B is stuck onto the cartridge attachment portion 118. The cartridge attachment portion 118 guides compressed gas PA in the gas cartridge B stuck thereonto to the air chamber 116*a*.

A puncture frame 114 is fit into the grip 105. The puncture frame 114 forms the above-mentioned cartridge housing portion 111 and is long to the shape of the grip 105. A sliding surface 114*a* is formed on the wall surface of the puncture frame 114 on the rear side. The sliding surface 114*a* is not covered with the main frame 102 and is exposed on the rear side of the toy gun 101. The sliding surface 114*a* is parallel with the circumferential surface B0 (Refer to FIG. 11) of the gas cartridge B housed in the cartridge housing portion 111. An inclined portion 114*b* is protruded from the sliding surface 114*a*. The inclined portion 114*b* forms an inclined surface 114*c* so inclined that the inclined surface is protruded backward as it goes downward.

In another embodiment, the sliding surface 114*a* may be not formed in the puncture frame 114 but may be formed on the side surface of the main frame 102 on the rear side of the toy gun 101. In this case, the wall surface of the puncture frame 114 on the rear side may be exposed on the rear side of the toy gun 101 or may be covered with the main frame 102.

An insertion portion 115 is formed in one end portion of the puncture frame 114. The cylindrical portion 117 is fit into the insertion portion 115.

A clamp arm 121 as first arm element P1 is installed in the end portion of the puncture frame 114 on the opposite side to the insertion portion 115. The clamp arm 121 is in an L shape as laterally viewed and is placed in the area extended from the rear part to the lower part of the grip 105. The portion of the clamp arm 121 positioned on the rear side of the grip 105 will be designated as extended portion 121*a*. The portion of the clamp arm 121 positioned on the lower side of the grip 105 will be designated as arm lower part 121*b*. The extended portion 121*a* is extended from the arm lower part 121*b* so that the extended portion is opposed to the sliding surface 114*a*.

A rotation shaft 122 couples together the arm lower part 121*b* and the portion of the puncture frame 114 located below the cartridge housing portion 111. The clamp arm 121 is rotatable around the axis of the rotation shaft 122.

A roller shaft 123*a* is extended in the arm lower part 121*b* of the clamp arm 121 above the rotation shaft 122. The roller shaft 123*a* is extended from the arm lower part 121*b* in parallel with the rotation shaft 122. A roller 123 is installed on the roller shaft 123*a*. The roller 123 is rotatable around the axis of the roller shaft 123*a*. The roller 123 is positioned between the bottom portion B2 (Refer to FIG. 11) of the gas cartridge B housed in the cartridge housing portion 111 and the rotation shaft 122. The roller 123 is moved in conjunction with the rotation of the clamp arm 121 and pushes upward the bottom portion B2 (Refer to FIG. 11) of the gas cartridge B housed in the cartridge housing portion 111. Thus the roller 123 functions as a pressing portion 123*b*.

Figure 5:
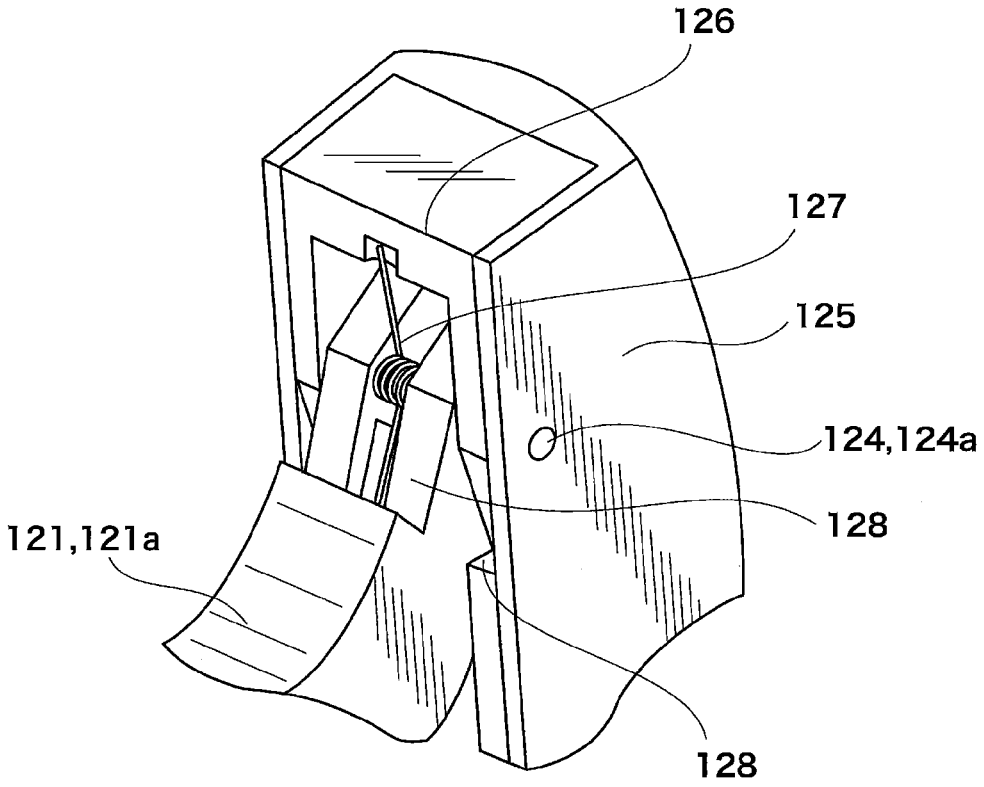
FIG. 5 is a perspective view of a clamp arm and a raising lever as viewed from the front side of the toy gun.
Figure 6:
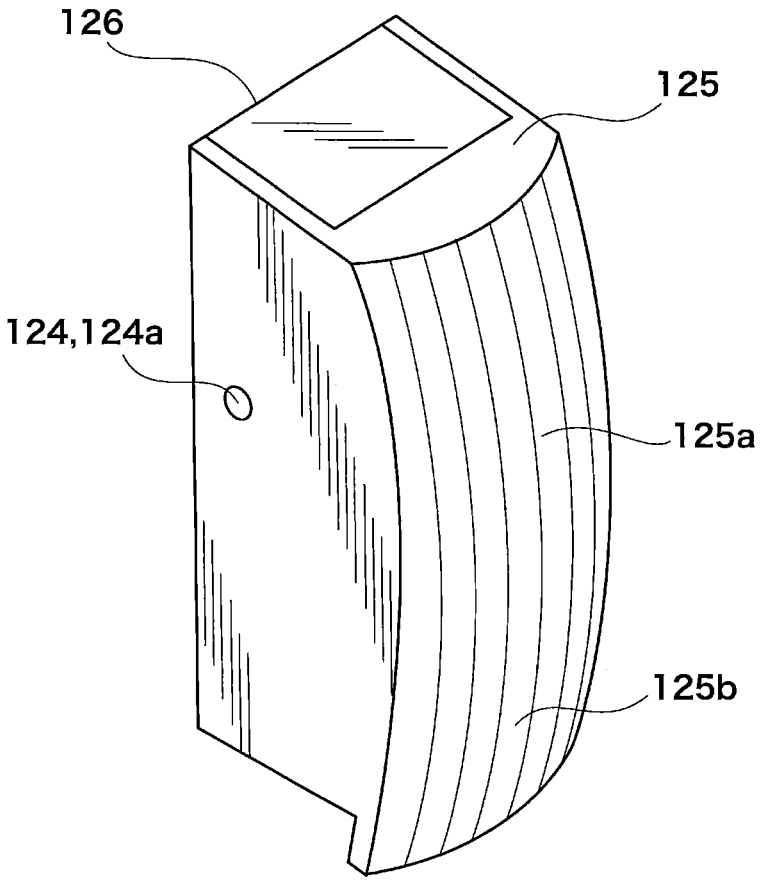
FIG. 6 is a perspective view of a raising lever as viewed from the rear side of the toy gun.

FIG. 5 is a perspective view of the clamp arm 121 and a raising lever 125 as viewed from the front side of the toy gun 101. FIG. 6 is a perspective view of the raising lever 125 as viewed from the rear side of the toy gun 101. FIG. 4, FIG. 5, and FIG. 6 will be referred to. The raising lever 125 as second arm element P2 is installed at the end portion of the clamp arm 121 above the extended portion 121*a* through an installation shaft 124. The raising lever 125 is coupled to the extended portion 121*a* so that the raising lever can be freely rotated around the installation shaft 124. Thus the installation shaft 124 functions as a fulcrum portion 124*a*.

The front side of the upper end of the raising lever 125 functions as an abutment portion 126. The abutment portion 126 slides on the sliding surface 114*a* and the inclined surface 114*c*. A description will be given to this regard later with reference to FIG. 7 and FIG. 8.

FIG. 5 and FIG. 6 will be especially referred to. A vertical-striped design surface 125*a* is formed on the side surface of the raising lever 125 on the rear side, extending from the upper end to the lower end. The design surface 125*a* is exposed on the rear side of the toy gun 101.

The raising lever 125 has an operation portion 125*b*. The operation portion 125*b* is positioned on the opposite side to the abutment portion 126 with respect to the installation shaft 124. The operation portion 125*b* is extended to below the installation shaft 124 and covers the side surface of the arm lower part 121*b* on the rear side. When a user holds and pulls backward the operation portion 125*b*, the operation portion 125*b* is broken away from the extended portion 121*a* and the abutment portion 126 is moved to ahead of the installation shaft 124. A torsion spring 127 is placed so that the torsion spring is wound around the installation shaft 124. The torsion spring 127 pushes backward the portion of the raising lever 125 located above the installation shaft 124. For this reason, when the user releases the operation portion 125*b*, the abutment portion 126 is moved backward and the operation portion 125*b* is brought close to the extended portion 121*a*.

A groove portion 128 agreeing with the shape of the inclined portion 114*b* of the puncture frame 114 is formed both in the clamp arm 121 and in the raising lever 125.

Figure 7:
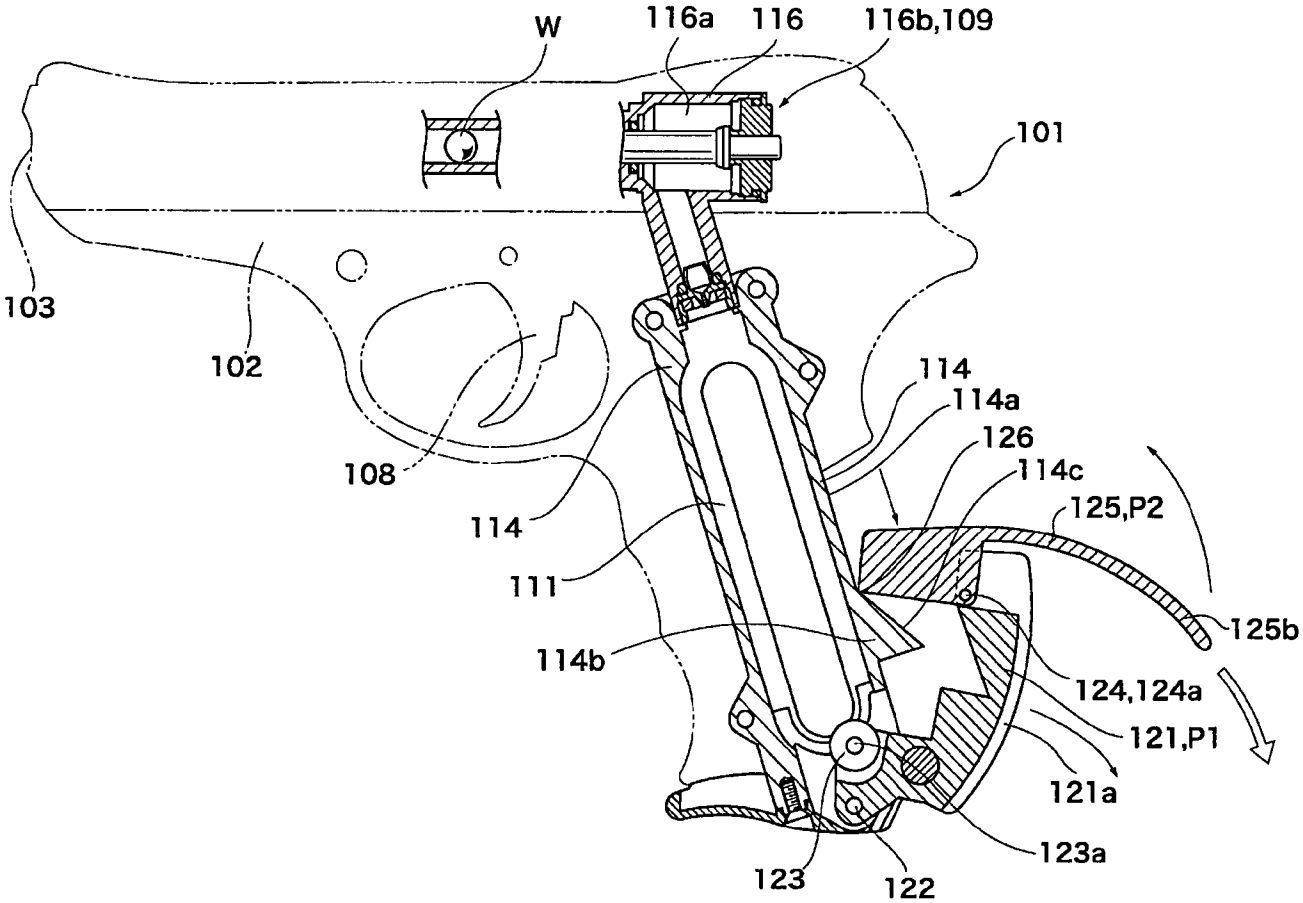
FIG. 7 is a sectional view of a toy gun with the operation portion thereof pulled up.

FIG. 7 is a sectional view of the toy gun 101 with the operation portion 125*b* pulled up. When a user pulls upward the operation portion 125*b* to the rear side of the toy gun 101, the raising lever 125 is rotated around the installation shaft 124. As a result, the abutment portion 126 is brought into contact with the sliding surface 114*a* and slides downward. Then the extended portion 121*a* is moved backward and is broken away from the puncture frame 114. As a result, the clamp arm 121 is rotated backward around the rotation shaft 122.

Figure 8:
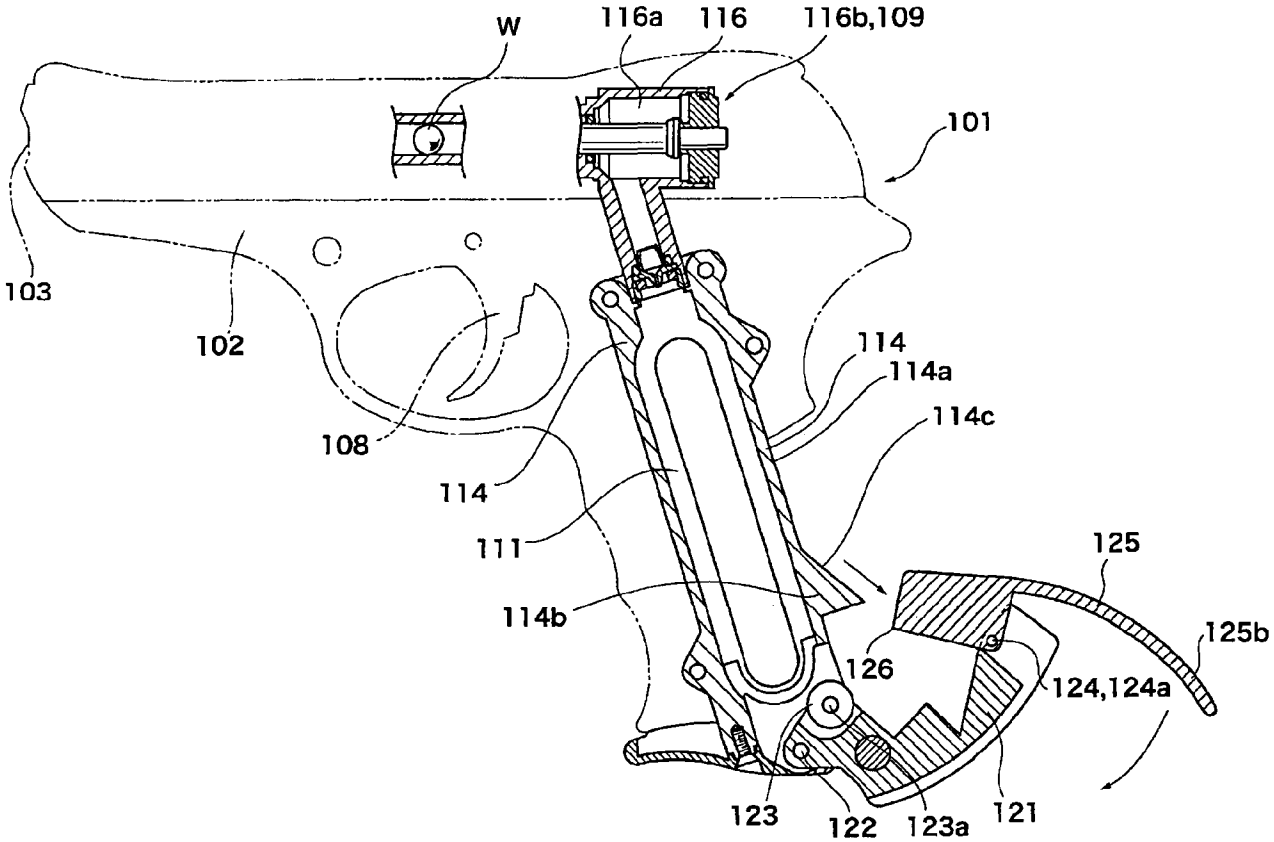
FIG. 8 is a sectional view of a toy gun obtained when the abutment portion thereof has just finished sliding on the inclined surface thereof.

FIG. 8 is a sectional view of the toy gun 101 obtained when the abutment portion 126 has just finished sliding on the inclined surface 114*c*. When the abutment portion 126 is further moved downward from the state illustrated in FIG. 7, the abutment portion 126 is brought into contact with the inclined surface 114*c*. The abutment portion is further moved to the rear side of the toy gun 101 so that the abutment portion is broken away from the puncture frame 114. As a result, the clamp arm 121 is further rotated to the rear side around the rotation shaft 122. At this time, the operation portion 125*b* of the raising lever 125 is protruded backward from the grip 105 and becomes easy for a user to hold. The user can pinch the thus protruded operation portion 125*b* and pull the raising lever 125 backward and downward as indicated by the thick arrow in FIG. 7 to rotate the clamp arm 121.

Attention will be paid to the roller 123 with reference to FIG. 4, FIG. 7, and FIG. 8. As the operation portion 125*b* is pulled up, the clamp arm 121 is rotated backward around the rotation shaft 122. As the extended portion 121*a* is broken away from the puncture frame 114, the roller shaft 123*a* is moved. As a result, the roller 123 is moved to below the cartridge housing portion 111.

The user can also pinch the operation portion 125*b*, overlap the raising lever 125 with the extended portion 121*a* (Refer to FIG. 12 and FIG. 13), and push upward the clamp arm 121 pulled out backward. In this case, the raising lever 125 and the clamp arm 121 are rotated around the rotation shaft 122. The roller 123 is moved upward and gets into the cartridge housing portion 111.

Figure 9:
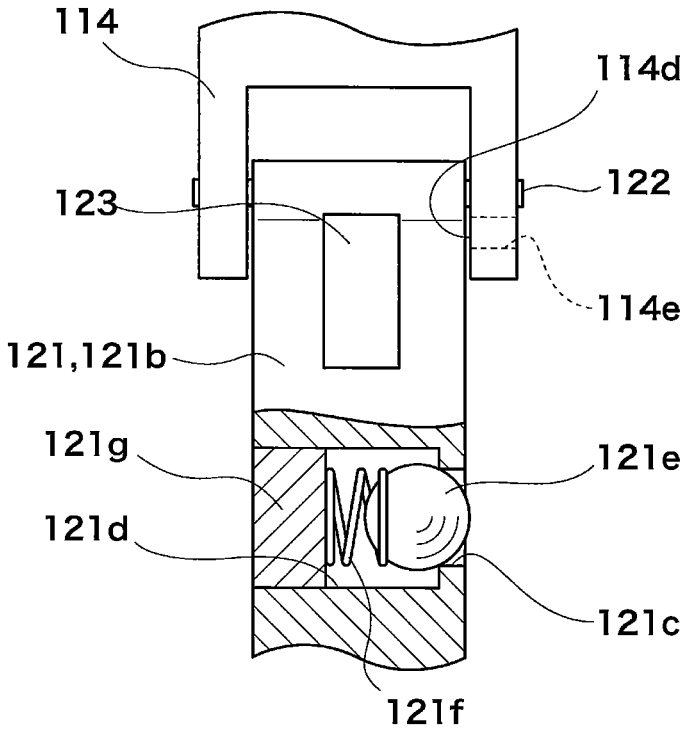
FIG. 9 is a side view of the rear side of a puncture frame.

FIG. 9 is a side view of the rear side of the puncture frame 114. A bearing hole 121*c* and a press-fit hole 121*d* are formed in the arm lower part 121*b* of the clamp arm 121. The bearing hole 121*c* and the press-fit hole 121*d* communicate with each other. The bearing hole 121*c* is open on the right side of the toy gun 101. The press-fit hole 121*d* is open on the left side of the toy gun 101. A bearing ball 121*e*, a spring 121*f*, and press-fit rubber 121*g* are introduced into the press-fit hole 121*d* in this order. The diameter of the bearing hole 121*c* is smaller than the diameter of the bearing ball 121*e*. For this reason, a part of the bearing ball 121*e* is protruded from the bearing hole 121*c* to the right side of the arm lower part 121*b*. Thus the bearing ball 121*e* does not drop off from the bearing hole 121*c*. The press-fit rubber 121*g* is press fit into the press-fit hole 121*d* and prevents the bearing ball 121*e* and the spring 121*f* from dropping off. The spring 121*f* pushes the bearing ball 121*e* to the right side of the toy gun 101.

Figure 10:
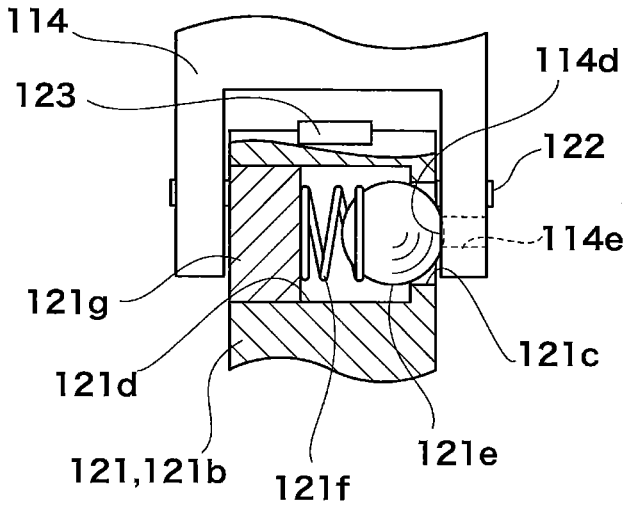
FIG. 10 is a side view of the rear side of a puncture frame with a clamp arm pushed up.

FIG. 10 is a side view of the rear side of the puncture frame 114 with the clamp arm 121 pushed up. A ball receiving portion 114*d* is formed in the right part of the puncture frame 114 in proximity to the rotation shaft 122. The ball receiving portion 114*d* is an end portion of a through hole 114*e* penetrating the puncture frame 114 in the direction of the width of the toy gun 101.

When the clamp arm 121 is rotated upward, the bearing ball 121*e* hits the puncture frame 114. The bearing ball 121*e* is pushed by the puncture frame 114 and pushes the spring 121*f* and gets into the ball receiving portion 114*d*. When the clamp arm 121 is further rotated upward in this state, the bearing ball 121*e* slides on the inside surface of the puncture frame 114 and eventually meets the ball receiving portion 114*d*. At this time, the spring 121*f* pushes the bearing ball 121*e* toward the ball receiving portion 114*d*. As a result, even though the user releases the raising lever 125 (Refer to FIG. 8 and the like), the clamp arm 121 is not rotated downward. When the user pulls up the operation portion 125*b* (Refer to FIG. 4 and the like) with predetermined or higher force to move the clamp arm 121, the following takes place: the bearing ball 121*e* becomes ready to slide out onto the inside surface of the puncture frame 114 and pushes the spring 121*f* and gets into the ball receiving portion 114*d*.

Figure 11:
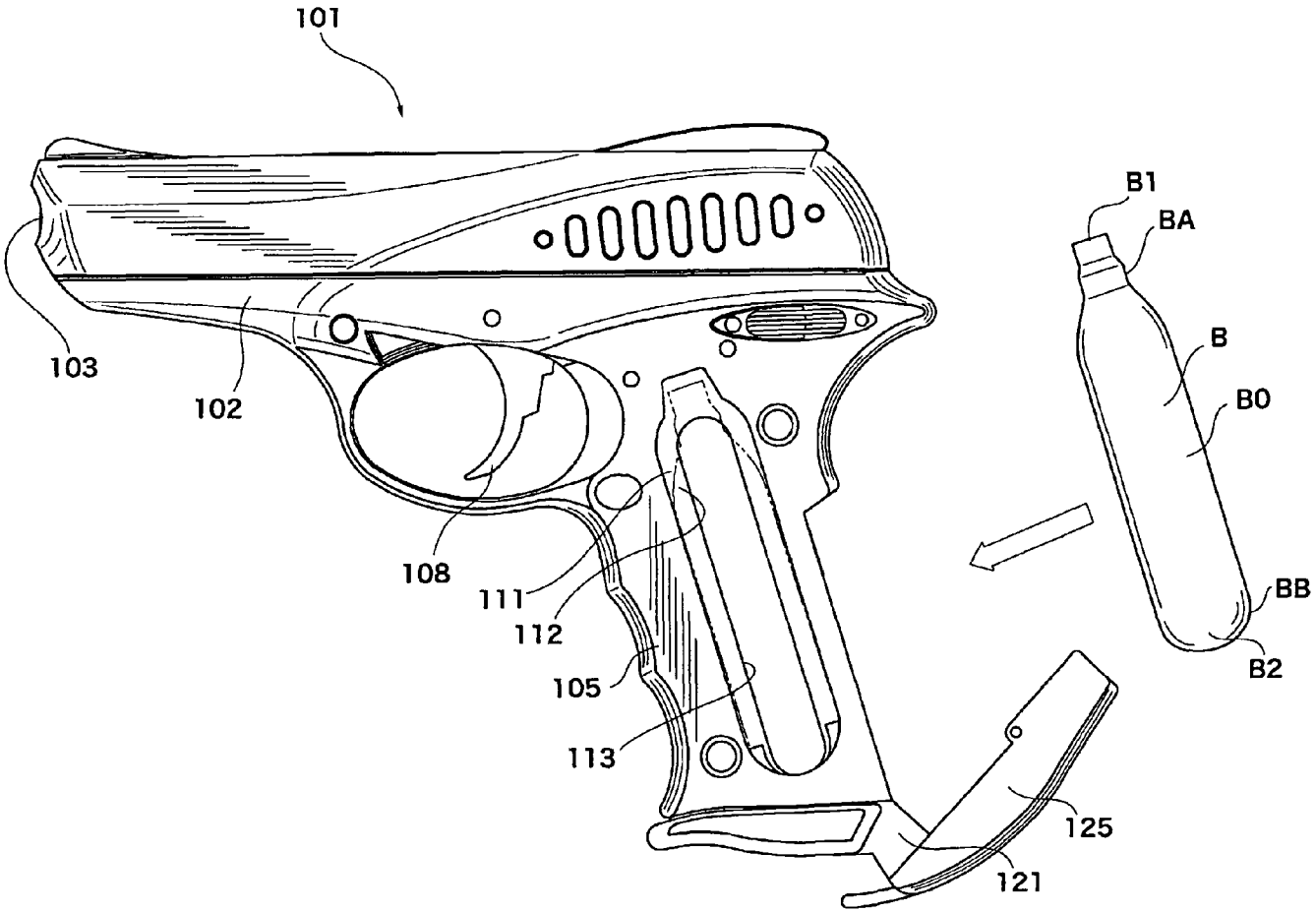
FIG. 11 is a side view of a toy gun illustrating how a gas cartridge is attached to the toy gun.

FIG. 11 is a side view of the toy gun 101 illustrating how a gas cartridge B is attached to the toy gun 101. The toy gun 101 is loaded with the gas cartridge B. The gas cartridge B is formed of, for example, a metal material. The gas cartridge B is cylindrical. The gas cartridge B is filled therein with compressed gas PA. (Refer to FIG. 12 and the like.) Examples of the compressed gas PA are carbon dioxide, chlorofluorocarbon, alternative for chlorofluorocarbon, and the like. One end portion (first end portion BA) of the gas cartridge B is narrowed. A lid portion B1 is formed at the tip of the first end portion BA. The lid portion B1 is formed of a film-like material and seals the compressed gas PA in the gas cartridge B. A bottom portion B2 is formed at the end portion (second end portion BB) of the gas cartridge B located on the opposite side to the first end portion BA. The bottom portion B2 is semi-spherical.

A description will be given to the procedure for attaching the gas cartridge B to the toy gun 101. A user first pinches the tab portion 106*a* (Refer to FIG. 1) and removes the left grip panel 106 (Refer to FIG. 1) from the grip 105. As a result, the cartridge housing portion 111 is exposed. The user moves the clamp arm 121 in accordance with the procedure described later with reference to FIG. 14 to retreat the roller 123 (Refer to FIG. 4, FIG. 7, FIG. 8, FIG. 12, and the like) downward from the cartridge housing portion 111. At this time, both the clamp arm 121 and the raising lever 125 are protruded backward from the grip 105.

Figure 12:
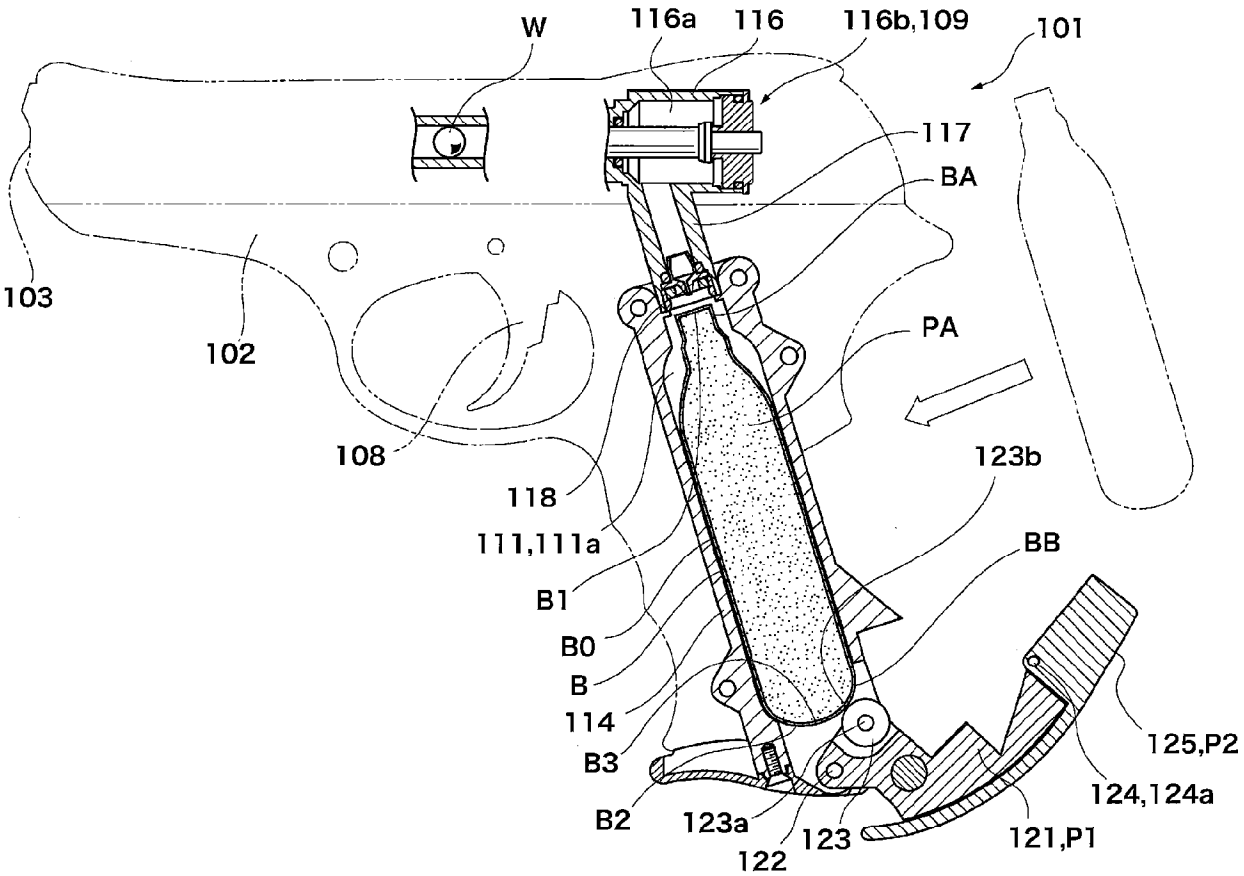
FIG. 12 is a sectional view of a toy gun with a gas cartridge positioned in the cartridge housing portion thereof.

FIG. 12 is a sectional view of the toy gun 101 with the gas cartridge B positioned in the cartridge housing portion 111. The user subsequently introduces the gas cartridge B from the introduction port 112 into the cartridge housing portion 111. At this time, the user brings the circumferential surface of the gas cartridge B into contact with the holding hole 113 (Refer to FIG. 11 and the like). He/she thereby opposes the lid portion B1 to the cartridge attachment portion 118 and the bottom portion B2 to the roller 123.

Figure 13:
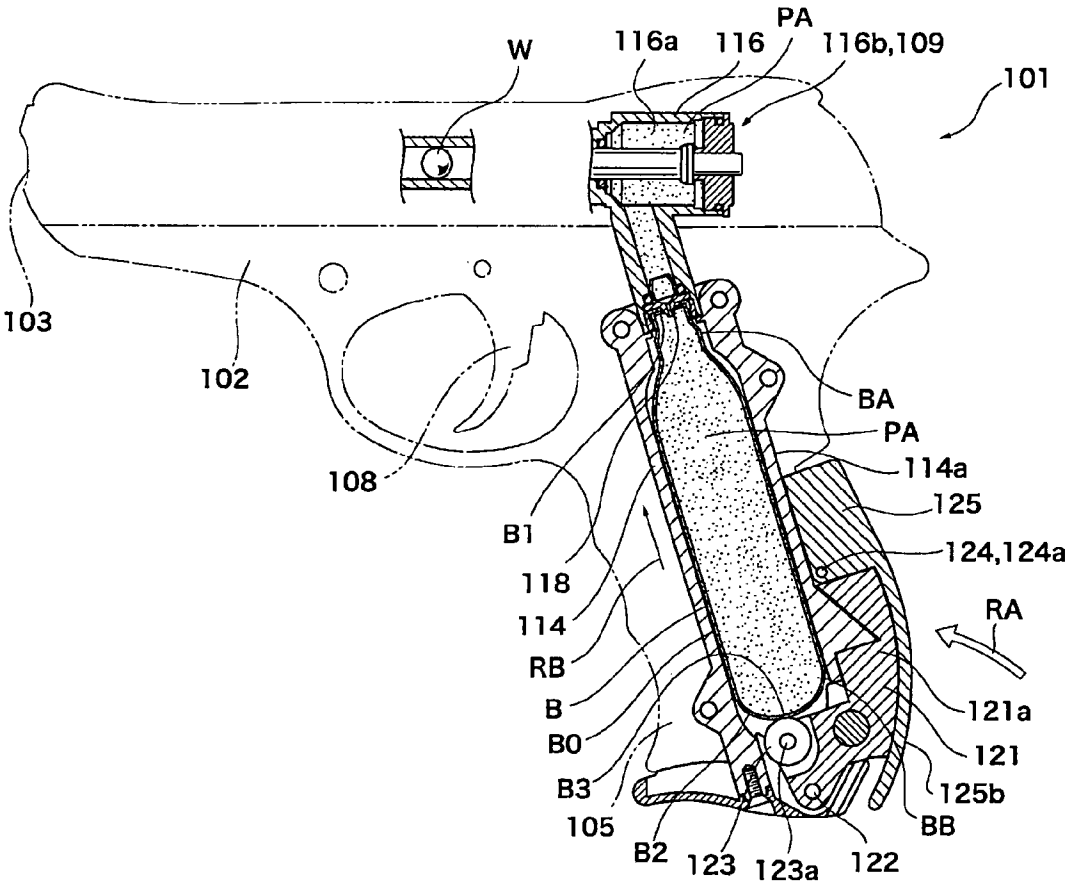
FIG. 13 is a sectional view of a toy gun with the raising lever thereof pushed up.

FIG. 13 is a sectional view of the toy gun 101 with the raising lever 125 pushed up. The user subsequently overlaps the raising lever 125 with the clamp arm 121. He/she holds the raising lever 125 and rotates the raising lever in the direction indicated by the arrow RA in FIG. 13 to bring the extended portion 121*a* of the clamp arm 121 into contact with the sliding surface 114*a*. As a result, the roller 123 is rotated around the rotation shaft 122 and is brought into contact with the bottom portion B2 of the gas cartridge B. When the raising lever 125 is further moved, the roller 123 is rotated around the roller shaft 123*a* and rolls along the bottom portion B2. At this time, the roller 123 pushes up the gas cartridge B to the direction indicated by the arrow RB in FIG. 13. As a result, the lid portion B1 is pierced by the cartridge attachment portion 118. Thus the compressed gas PA in the gas cartridge B gets into the air chamber 116*a*.

Attention will be paid to the movement of the roller 123 relative to the bottom portion B2 of the gas cartridge B. FIG. 12 will be referred to. When the raising lever 125 is pushed up, the roller 123 is first brought into contact with the area in the bottom portion B2 of the gas cartridge B located closer to the rear side of the toy gun 101 than the lowest point B3 is. As the clamp arm 121 is rotated, the roller 123 rolls along the bottom portion B2 of the gas cartridge B. The roller goes past the lowest point B3 and arrives at the area in the bottom portion B2 located closer to the front side of the toy gun 101 than the lowest point B3 is. When the roller 123 goes past the lowest point B3, the roller moves hardest the gas cartridge B to the direction indicated by the arrow RB. (Refer to FIG. 13.) After the roller 123 goes past the lowest point B3, the roller is stopped in proximity to the lowest point B3 and sandwiches and fixes the gas cartridge B between the roller and the cartridge attachment portion 118. At this time, as mentioned above, the holding hole 113 (Refer to FIG. 11 and the like) has held the circumferential surface B0 (Refer to FIG. 11) of the gas cartridge B. For this reason, the gas cartridge B is not displaced in the cartridge housing portion 111. The cartridge housing portion 111 is thereafter closed by the left grip panel 106. (Refer to FIG. 1.)

When the user pulls the trigger 108 with the cartridge attachment portion 118 stuck into the lid portion B1, the gas spout mechanism 116*b* is actuated and compressed gas PA in the air chamber 116*a* spouts out toward the muzzle 103. The spouted-out compressed gas PA pushes a bullet W (Refer to FIG. 4) loaded in the toy gun 101 and shoots the bullet W out of the muzzle 103. Even without the left grip panel 106 (Refer to FIG. 1) attached to the grip 105, the bullet W is fired.

Figure 14:
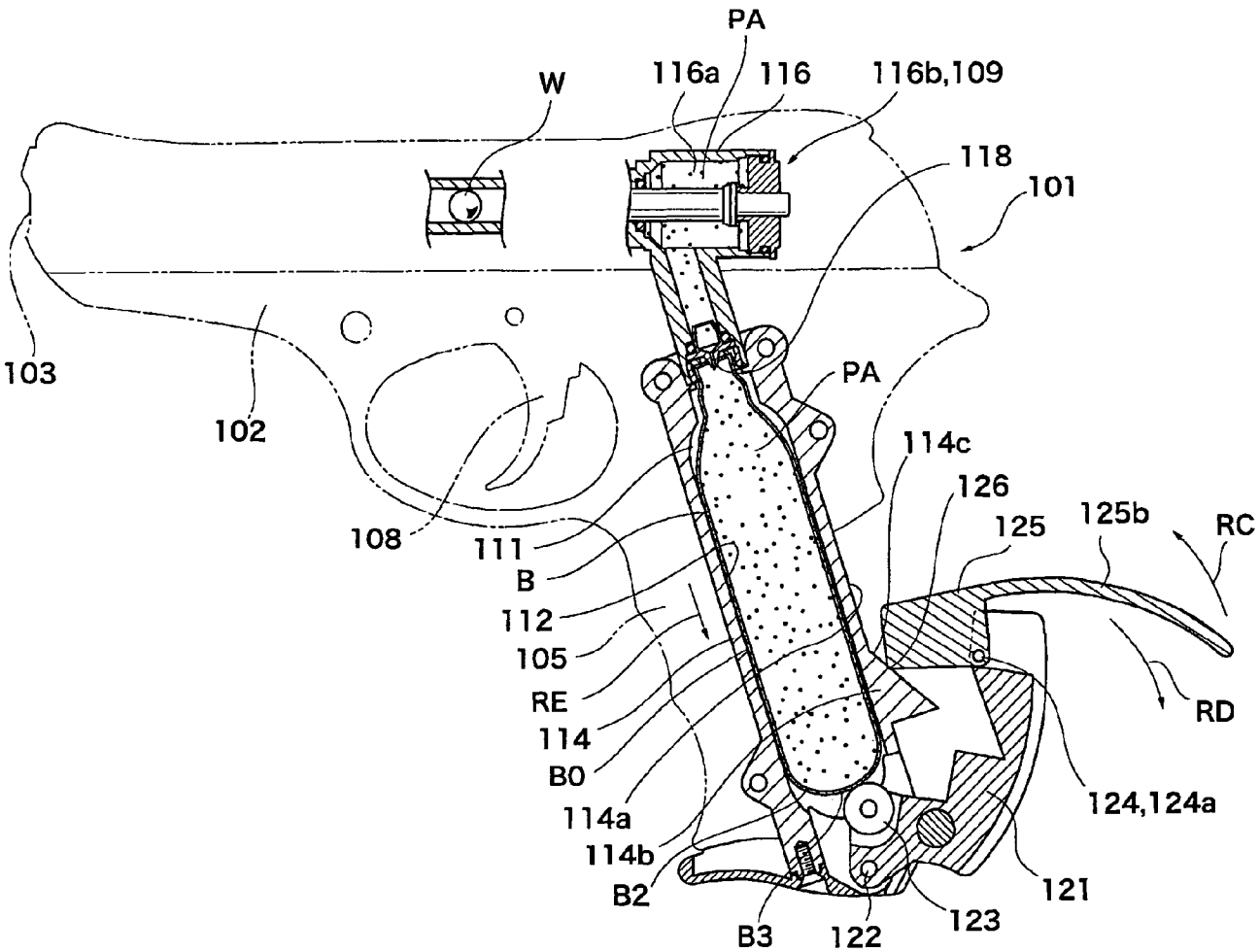
FIG. 14 is a sectional view of a toy gun with a gas cartridge kept attached to the toy gun and the operation portion thereof pulled up.

FIG. 14 is a sectional view of the toy gun 101 with the gas cartridge B attached to the toy gun 101 and the operation portion 125*b* pulled up. The quantity of compressed gas PA in the gas cartridge B is reduced and the pressure of compressed gas PA in the air chamber 116*a* becomes insufficient to fire a bullet W, it is necessary to replace the gas cartridge B. In this case, the gas cartridge B is removed from the toy gun 101 as described below:

First, the user removes the left grip panel 106 (Refer to FIG. 1) from the grip 105. As a result, the gas cartridge B in the cartridge housing portion 111 is exposed.

The user subsequently pulls up the operation portion 125*b* of the raising lever 125 to the direction indicated by the arrow RC in FIG. 14. The raising lever 125 is thereby rotated around the installation shaft 124 relative to the clamp arm 121. The abutment portion 126 slides along the sliding surface 114*a* and the inclined surface 114*c* and is moved downward. The clamp arm 121 is rotated around the rotation shaft 122 in the direction indicated by the arrow RD in FIG. 14. As a result, the roller 123 rolls on the bottom portion B2 of the gas cartridge B, climbs over the lowest point B3, moves to the area closer to the rear side of the toy gun 101 than the lowest point B3 is, and is retreated from the cartridge housing portion 111. As a result, a gap is produced between the bottom portion B2 of the gas cartridge B and the roller 123 and the gas cartridge B can be slid downward in the cartridge housing portion 111.

The user subsequently touches the circumferential surface B0 (Refer to FIG. 11) of the gas cartridge B through the introduction port 112 and moves the gas cartridge B to the direction indicated by the arrow RE in FIG. 14. As a result, the lid portion B1 of the gas cartridge B comes off from the cartridge attachment portion 118. Then the user takes the gas cartridge B out of the cartridge housing portion 111 through the introduction port 112.

According to the toy gun 101 in this embodiment, the following takes place when a user of the toy gun 101 moves the operation portion 125*b* to slide the abutment portion 126 along the sliding surface 114*a*: the fulcrum portion 124*a* is broken away from the cartridge housing portion 111 and the clamp arm 121 (first arm element P1) is rotated. The distance between the abutment portion 126 and the operation portion 125*b* is longer than the distance between the abutment portion 126 and the fulcrum portion 124*a*. For this reason, the user only has to apply small force. Since the operation portion 125*b* is brought far away from the cartridge housing portion 111, the user can easily pinch the raising lever 125. Therefore, it is possible to firmly attach a gas cartridge B to the toy gun 101 through simple operation and the gas cartridge can be easily replaced.

It is unnecessary to provide the clamp arm 121 (first arm element P1) with a part to be pinched by a user. For this reason, the design of the toy gun 101 is not impaired.

In the toy gun 101 in this embodiment, the pressing portion 123*b* is comprised of the roller 123 rotatably provided on the clamp arm 121. As a result, the roller 123 rolls along the bottom portion B2 without the bottom portion B2 of the gas cartridge B being shaven. For this reason, when a user moves the raising lever 125, the gas cartridge B is smoothly moved in the cartridge housing portion 111.

The toy gun 101 in this embodiment includes the inclined portion 114*b*. The inclined surface 114*c* formed by the inclined portion 114*b* is inclined from the sliding surface 114*a* so that the following is implemented: the inclined surface is brought farther away from the circumferential surface B0 of a gas cartridge B housed in the cartridge housing portion 111 as it goes toward the rotation shaft 122. For this reason, the clamp arm 121 is largely rotated and the clamp arm 121 and the raising lever 125 are largely protruded from the grip 105 just by the operation portion 125*b* being slightly pulled up.

What is claimed is:

1. A toy gun comprising:

an air chamber body forming an air chamber for storing compressed gas;

a discharge mechanism discharging compressed gas in the air chamber; and a grip assembly extending away from the air chamber body and the discharge mechanism and terminating at a grip end portion with a central grip portion disposed between the grip end portion and the air chamber body, the grip assembly having a rearwardly-facing grip sliding surface and including:

a cartridge housing portion housing a cylindrical gas cartridge filled with compressed gas and slidably holding the circumferential surface of the gas cartridge;

a cartridge attachment portion coupled with a first end portion of a gas cartridge housed in the cartridge housing portion and guiding compressed gas in the gas cartridge to the air chamber;

a first arm element that includes a pressing portion and an extended portion connected to the pressing portion and pivotally connected to the grip end portion of the grip assembly; and a second arm element including an abutment portion, an operation portion and a fulcrum portion disposed between and integrally connected to the abutment portion and the operation portion with the fulcrum portion pivotally connected to the extended portion of the first arm element such that the first and second arm elements move relative to each other to and between a closed position and an open position, wherein, in the closed position, the pressing portion presses against a bottom part of the gas cartridge in a direction towards the air chamber body, the fulcrum portion and the abutment portion facially oppose the rearwardly-facing grip sliding surface along the central grip portion and the operation portion covers the extended portion facially opposing the rearwardly-facing grip sliding surface with the abutment portion and the operation portion forming a rearward side of the grip assembly and, moving from the closed position to the open position, simultaneously, the operation portion pivots rearwardly away from the extended portion, the extended portion pivots relative to the grip end portion causing the pressing portion to pivot rearwardly and away from the bottom part of the gas cartridge and the abutment portion, at least initially, moves in sliding contact downwardly along the rearwardly-facing grip sliding surface of the grip assembly.

2. The toy gun according to claim 1, wherein the pressing portion includes a roller rotatably provided on the first arm element.

3. The toy gun according to claim 1 or 2, wherein the rearwardly-facing grip sliding surface includes an inclined portion that extends rearwardly and downwardly away from the air chamber.

* * * * *